United States Patent [19]

Perigo et al.

[11] Patent Number: 5,054,265

[45] Date of Patent: Oct. 8, 1991

[54] METHOD OF ASEPTIC PACKAGING AND CLOSING CONTAINERS

[75] Inventors: John A. Perigo, Near Witney; Geoffrey Tucker, Swindon, both of England

[73] Assignee: CMB Foodcan plc, United Kingdom

[21] Appl. No.: 548,208

[22] Filed: Jul. 3, 1990

Related U.S. Application Data

[63] Continuation of Ser. No. 312,427, Feb. 9, 1989, abandoned, which is a continuation of Ser. No. 220,420, Jul. 19, 1988, abandoned, which is a continuation of Ser. No. 73,886, Jun. 16, 1988, abandoned, which is a continuation of Ser. No. 828,305, Feb. 12, 1986, abandoned.

[30] Foreign Application Priority Data

May 14, 1984 [GB] United Kingdom ..... 8412244

[51] Int. Cl.[5] ..... B65B 55/04; B65B 55/12; B65B 7/28

[52] U.S. Cl. ..... 53/425; 53/426; 53/486; 53/471; 53/488; 413/6

[58] Field of Search ..... 53/425, 426, 471, 486, 53/488

[56] References Cited

U.S. PATENT DOCUMENTS

| | | | |
|---|---|---|---|
| 3,263,636 | 8/1966 | Smith | 446/465 |
| 3,311,033 | 3/1967 | Fetton et al. | 493/102 |
| 3,774,560 | 11/1973 | Hartz | 413/6 |
| 3,839,843 | 10/1974 | Stewart, Jr. | 53/471 |
| 4,270,475 | 6/1981 | Fletcher et al. | 220/75 |

FOREIGN PATENT DOCUMENTS

| | | | |
|---|---|---|---|
| 0035027 | 3/1983 | Japan | 413/6 |
| 422690 | 4/1967 | Switzerland . | |
| 256374 | 8/1926 | United Kingdom . | |
| 547229 | 8/1942 | United Kingdom . | |
| 1220129 | 1/1974 | United Kingdom | 413/2 |
| 2067158 | 7/1981 | United Kingdom . | |
| 2089191 | 6/1982 | United Kingdom . | |

*Primary Examiner*—Frederick R. Schmidt
*Assistant Examiner*—Jack Lavinder
*Attorney, Agent, or Firm*—Christie, Parker & Hale

[57] ABSTRACT

A packaging container is closed by using a double seam 152 to secure over the container body 70 a cover 74 of smaller diameter than is usual, creating a radial space 104 around the cover chuck wall 122 into which the body sidewall 72 is deformed to form a neck 76. The cover is initially placed on the body to form a sealable interface 142 therebetween, this interface being preserved throughout the seaming process. The body and/or the cover may be of plastics or metal or a laminated material. In an aseptic packaging process, a primary seal is created at the interface 142 under sterile conditions, seaming subsequently being carried out under non-sterile conditions.

12 Claims, 3 Drawing Sheets

METHOD OF ASEPTIC PACKAGING AND CLOSING CONTAINERS

CROSS-REFERENCE TO RELATED APPLICATIONS

This is a continuation of application Ser. No. 07/312,427, filed Feb. 9, 1989, now abandoned, which is a continuation of application Ser. No. 07/220,420, filed July 19, 1988, now abandoned, which is a continuation of application Ser. No. 7/073,886, filed June 16, 1988, now abandoned, which is a continuation of Ser. No. 06/828,305, filed Feb. 12, 1986, now abandoned.

This invention relates to methods of closing a container by securing to a container body a cover by means of a double seam.

The cover is generally of the kind having a peripheral cover portion which comprises a chuck wall extending upwardly to merge with a seaming panel. The latter includes a terminal cover curl. The container body has a side wall terminating in a peripheral body portion which comprises an end portion of the sidewall merging with an outwardly directed seaming flange.

It will be understood that, for convenience, this specification and the appended claims are written in terms of closing an open end at the top of the container body. However, as is well known it is perfectly possible in many instances for the body to be so orientated that the open end to be closed is not facing vertically upwards. Terms such as "upward" or "downward", and so on, are to be taken accordingly to refer to the direction that would be upward or downward, and so on, if the open end of the body happens to be at the top, but without implying that it must be at the top.

The conventional method of forming a double seam between a metal can and a metal cover (can end) requires the application of a comparatively large applied axial force during the seaming process itself, in order to establish a satisfactory length of body hook in the seam. This at present makes it impracticable to use double seaming for closing containers having bodies too weak to withstand this force, for example, those of thermoformed plastics or certain laminated plastics, or of metal which is exceptionally thin (by current standards). This has made it impracticable to make a double seam, which remains a most effective and well-tried means of obtaining a permanent hermetic seal, on many kinds of packaging containers now being proposed or developed and in other respects offering attractive advantages over more conventional containers.

An object of the invention is to provide a method of double seaming which enables a sufficiently long body hook to be formed with a substantially reduced applied axial load during the seaming process.

Another object is to provide a process suitable for use with container bodies which are either of laminated materials consisting wholly or partly of plastics, or of very thin metal, or of thermoformed laminated or unlaminated plastics, enabling in each case a cover of metal or plastics (laminated or otherwise) to be double-seamed to the body.

A problem which does not normally arise with conventional metal cans is the danger of the container body becoming perforated within the double seam by the sharp edges of wrinkles which may be formed in the cover curl during the first seaming operation, but which are ironed out again during the second operation. With bodies of materials affording a significantly softer or weaker sidewall, however, the resulting reduction in reaction force will tend to reduce the ability of the wrinkles to be ironed out; consequently, if the cover is of a harder or stronger material than the body, the wrinkles may puncture the side wall.

Another object of the invention is accordingly to reduce the tendency for such wrinkles to form in the first place.

There have also hitherto been problems in connection with the application of double seaming to aseptic packaging. Aseptic packaging is here defined as the filling of a sterile product into sterilised container bodies followed by hermetically sealing these with sterilised closures (covers) in an environment free of microorganisms.

Where the desirable final container form is a filled container body closed with a double seamed cover it is possible to sterilise the container body and the cover, for example with superheated steam or hot air or hydrogen peroxide vapour. It is also possible to fill sterile product into the sterilised container body in an environment free of microorganisms, for example in a sterilised chamber filled with steam or sterilised air. It is similarly possible to place the sterilised cover on the filled container body in a similar chamber free of microorganisms. At this point, however, the pack has not been hermetically sealed. The hermetic seal is only completed when the cover has been double seamed to the container body.

Seaming machines for double-seaming are well known, but are difficult to incorporate into a sterilisable enclosure which can also be maintained free of microorganisms. Earlier attempts to do this have involved enclosing critical areas of the seaming machine and maintaining these areas at very high temperature with steam or hot air. This creates substantial mechanical problems on the seaming machine, for example due to thermal expansion of its component parts or breakdown of lubrication systems. The high-temperature environment also presents a problem if one, or each, component of the finished container is constructed from a material which is softened or melted at this high temperature, for example a plastics material.

It is suggested that these problems could be overcome by producing a temporary (or "primary") hermetic seal between the container body and cover while these are still within the sterile filling zone, thereby permitting the sealed pack to be removed from the sterile zone and subsequently double-seamed using a conventional seaming machine operating in non-sterile ambient conditions. Such a primary hermetic seal can be produced, for example, if a suitably lined cover is dropped on to the flange of a filled container body while the cover is still hot from the sterilisation process, and if pressure is then applied to cause the lining compound to seal to the body flange. This solution is only effective, however, if the primary hermetic seal is not then broken during the double seaming process.

In the conventional double seaming process, such a hermetic seal will be broken as a result of the relative movement between the seaming flange of the container body and the seaming panel of the cover during double seaming; and in consequence the asepsis of the pack is prejudiced.

When this seal is broken microorganisms will tend to be drawn into the headspace of the container by any reduced pressure in the headspace. In addition, the undersurface of the cover, outboard of the primary seal, will become non-sterile when the container is removed from sterile conditions. During conventional double seaming, a part of this surface is drawn towards the headspace, and may contaminate the interior of the container.

Further objects of the invention are accordingly to provide a method of double seaming in which a primary seal formed prior to the seaming step is not destroyed during the seaming step; to provide a method of double seaming in which the part of the cover curl outboard of such a seal is not drawn back towards the headspace of the container; and to provide a method of double seaming in which the seaming machine can be used in a non-sterile environment as part of an aseptic packaging system.

The invention will now be described, by way of example only, with reference to the drawings of this application, in which.

Figure 1:
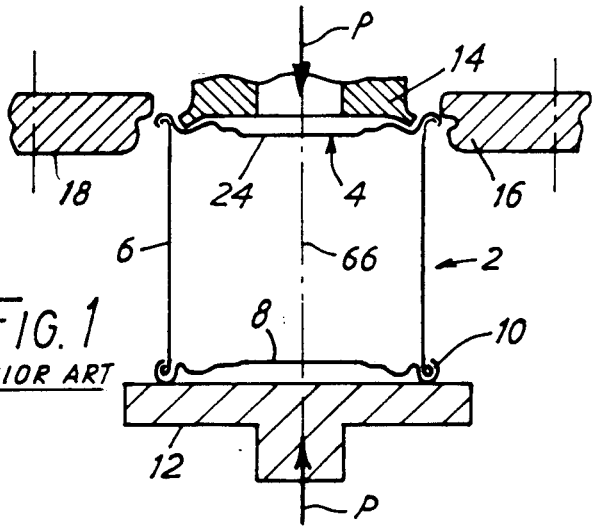
FIG. 1 PRIOR ART
FIG. 1 is a diagrammatic sectional elevation illustrating a conventional double-seaming process as practised in the closing of a three-piece metal can.
Figure 3:
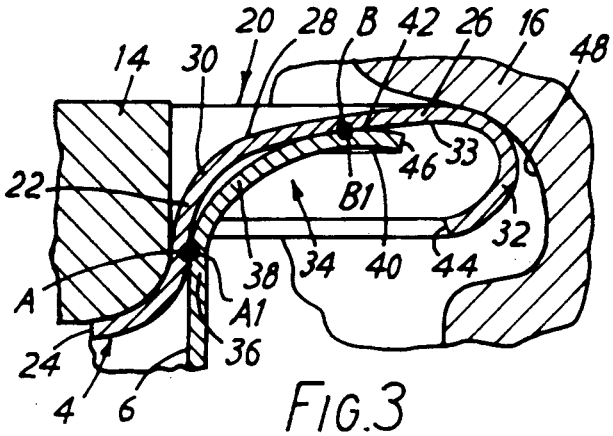
FIG. 3 PRIOR ART
FIGS. 3 to 6 are much-enlarged scrap sectional views showing four stages in the conventional double seaming process on a metal can.

The can 2 shown in FIG. 1 comprises a cylindrical body and a top cover or can end 4. The body consists of a body cylinder 6 and a bottom can end 8 secured to the body cylinder by a peripheral double seam 10. The operation of securing the cover 4 to the can body is performed in a conventional seaming machine which includes tooling in the form of a lift pad 12, a chuck 14, a first operation seaming roll 16 and a second operation seaming roll 18. As is best seen in FIG. 3, the cover 4 has a peripheral cover portion 20 which comprises a chuck wall 22, upstanding around the central panel portion 24 of the cover, and an annular seaming panel 26. The panel 26 has an upper portion 28, with which the chuck wall 22 merges in a radiused portion 30, and a terminal cover curl 32. The body cylinder 6 constitutes a sidewall which terminates in a peripheral body portion 34 comprising a cylindrical end portion 36 of the sidewall, merging in a radiused portion 38 with an out-turned seaming flange 40.

The conventional seaming process illustrated in FIGS. 3 to 6 comprises the following steps:

(1) a placing step in which, with the can body (filled with a product, not shown) resting on the lift pad 12, the cover 4 is located on the can body with the upper portion 26 of the seaming panel in overlying contact with the seaming flange 40, to define an initial interface, indicated at 42, between them. The chuck 14 is engaged within the chuck wall 22 in a slight interference fit, thus centralising the cover on the body, and bears on the centre panel 24 of the cover; and (2) a first seaming seaming operation The diameter of the chuck wall 22 is such that it fits quite closely within the sidewall end portion 36, as seen in FIG. 3, while the diameter of the terminal edge 44 of the cover curl is substantially larger than that of the edge 46 of the seaming flange. The seaming rolls 16 and 18 have respective profiled peripheral seaming grooves 48 and 50.

The first operation and second operations are performed respectively by the rolls 16 and 18. Throughout these operations, the can 2 is rotated about its axis 66 by the chuck 14 and lift pad 12, and a relatively high axial pressure P, FIG. 1 is applied to the can by the chuck and lift pad. This pressure is sufficient not only to hold the cover against the can body, but also to contribute forces having an axial component to the seaming operations themselves, as will be explained below. The rolls successively apply a generally transverse (i.e. radial in this example) seaming force around the seaming panel 26, so as to deform the latter and the flange 40 simultaneously with each other.

Figure 4:
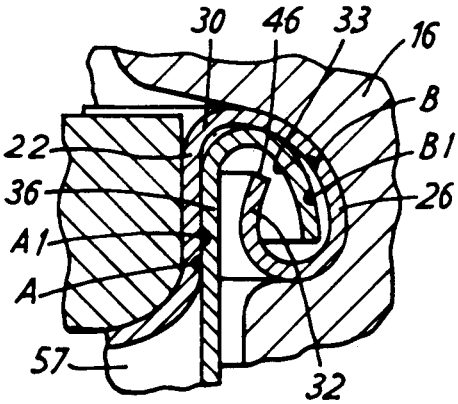
FIG. 4 PRIOR ART

FIGS. 3 and 4 show respectively the start and the finish of the first seaming operation, in which the roll 32 is advanced radially inwardly towards the can axis. The cover curl 32 is turned by the roll 16 inwardly and upwardly to the cross-sectional configuration seen in FIG. 4. At the same time, the flange 40 is turned downwardly, while being extended by virtue of the axial pressure P, FIG. 1, so as to lie within the curl 32. The peripheral portions 20 and 34, of the cover and body sidewall respectively, are then in interlocking relation. During the first seaming operation, there is thus relative sliding movement between the seaming panel 26 and the flange 40. This is illustrated by the contiguous points indicated at B and B1 in FIG. 3, which by the end of the operation have become separated as seen in FIG. 4, so that the initial interface 42 (and incidentally any primary hermetic seal that may have been established in that interface during the placing step) is destroyed. With particular reference to the general discussion earlier herein concerning the disadvantages of this conventional double-seaming process if used in aseptic packaging applications, it can be seen from a comparison of FIGS. 1 and 4 that the undersurface 33 of the cover, outboard of the interface 42, will be non-sterile if the seaming operation is carried out under non-sterile conditions, and that the deformation of the peripheral portion 20 of the cover is generally such that part of the surface 33 is drawn back towards the headspace 57 of the container. Since by the end of the first seaming operation (FIG. 4) there is no seal at the interface 42-even if such a seal did exist before seaming commenced-there is danger of the non-sterile surface so drawn back causing contamination within the body of the container.

It will also be noticed that at the end of the first seaming operation, the seaming panel has been deformed so as to conform with the profile of the seaming groove 48, while the axial pressure P deepens the chuck wall 22. As the wall portion 36 is extended upwardly, the adjacent radiused portion 38 is reduced. During this process, the two contiguous points A and A1 (FIG. 3) become axially separated. Finally, it is pointed out that, whereas the wall portion 36 and chuck wall are in close engagement with each other, the cover curl 32 remains radially spaced from the wall portion 36 throughout the first seaming operation.

Figure 5:
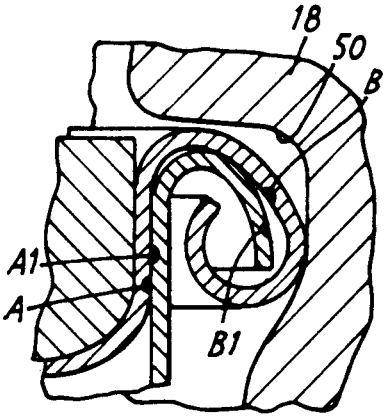
FIG. 5 PRIOR ART
Figure 6:
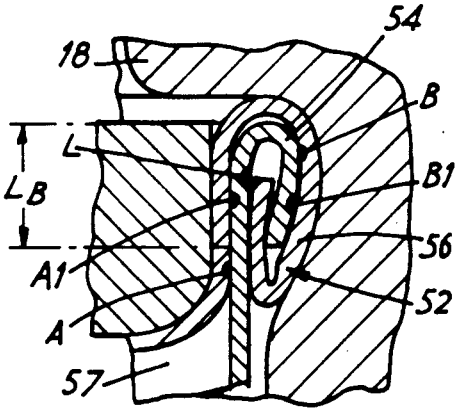
FIG. 6 PRIOR ART

At the end of the first seaming operation, the roll 16 is withdrawn and the roll 18 is engaged as shown in FIG. 5, illustrating the start of the second seaming operation. FIG. 6 shows the end of the second seaming operation, in which the roll 18 is advanced towards the axis of the can while the axial pressure P is maintained so as further to elongate the flange 40 and squeeze the peripheral portions 20 and 34 together into the final form of the peripheral double seam 52 shown in FIG. 6. The seam 52 now comprises a body hook 54 sealingly interlocked with a cover hook 56, the latter having an external profile conforming with that of the roll groove 50.

The separation between the points A and A1, and that between the points B and B1, are further increased during the second seaming operation.

The axial length $L_B$ of the terminal or radially inner portion of the body hook 54 is an important factor in determining the integrity of the double seam. As will be realised from the foregoing, the length $L_B$ is directly related to the magnitude of the axial pressure P. It is for this reason that, in practice, this pressure has to be considerable.

Figure 7:
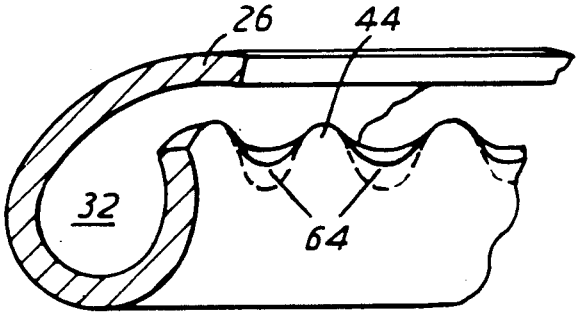
FIG. 7 shows the phenomenon of wrinkling which can occur during the conventional double-seaming process.

In the conventional process described above, as the first seaming operation proceeds (FIGS. 3 and 4), the edge 44 of the curl 32 is unsupported, and because its diameter is being progressively reduced it tends to form wrinkles, typically as shown at 64 in FIG. 7. These wrinkles are normally ironed out during the second seaming operation, when the five layers of material which comprise the finished double seam are compressed together.

Figure 2:
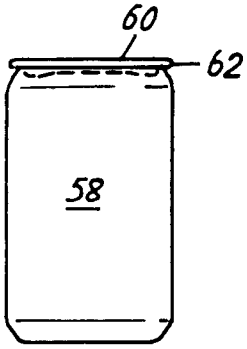
FIG. 2 PRIOR ART
FIG. 2 is a side elevation of a typical container comprising a unitary body closed by a cover double-seamed to the body.

FIG. 2 shows a unitary container body 58, which may be of metal or of a suitable plastics material. A can end or cover 60 is secured over the open end of the body 58 in a double seam 62. The seam 62 can be formed conventionally in the manner described above if the body 58 and end 60 are both of metal.

Referring now to FIGS. 8 to 11; these illustrate a preferred method of closing a double-seamed container having a body 70 of plastics material, having a cylindrical sidewall 72 with a peripheral body portion 134 generally similar to the portion 34 of the can body seen in FIG. 3; sidewall 72 has an end portion 136, radiused portion 138, and seaming flange 140. The container has a cover 74 which in this example can be taken to be of substantially the same cross-sectional shape as the cover 4 in FIGS. 1 and 3 to 6; it has a center panel 124 and a peripheral cover portion 120 comprising a chuck wall 122 and a seaming panel 126, the latter consisting of an upper portion 128 and a cover curl 132 and being joined by a radiused portion 130 to the chuck wall 122.

The first and second operation seaming rolls, 116 and 118 respectively with their respective seaming grooves 148, 150, are generally similar to the rolls 16 and 18, except that the portion 78 of each roll below the groove is of low axial height to prevent interference with the can sidewall at the end of each operation, as can be appreciated from FIGS. 9 and 11.

Figure 8:
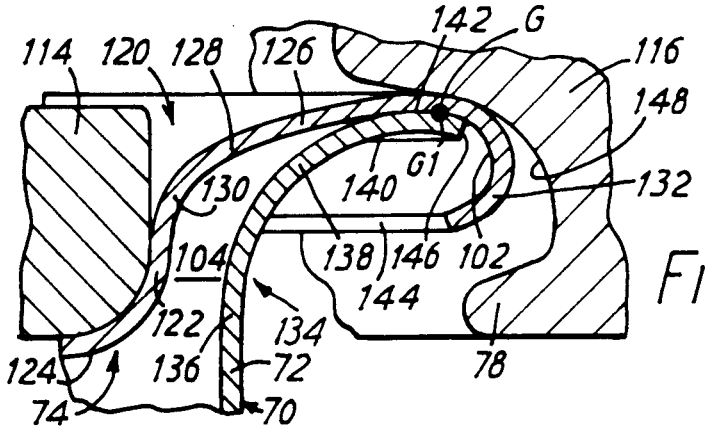
FIGS. 8 to 11 are views similar to FIGS. 3 to 6 respectively, but showing the equivalent four stages in the formation of a double seam by a method according to the invention.

For a given diameter of body sidewall, the cover 74 of FIG. 8 is of smaller diameter than the cover 4 which would be used if the conventional process shown in FIGS. 3 to 6 were to be employed. Thus the girth of the chuck wall 122 is such that when the cover is located, as in FIG. 8, on the body 70, the chuck wall is out of contact with the body sidewall 72 surrounding it. Instead of being located on the body by interference between the chuck wall and body sidewall, the cover 74 is located by nesting of the body flange 140, including its edge 146, against the underside of the seaming panel 126 in an initial interface 142 which, instead of lying, as in FIG. 3, about midway along the upper portion (28 in FIG. 3), is at the root of the cover curl 132. Two contiguous points at the interface 142, on the seaming panel 126 and flange 140, are indicated in FIG. 8 at G and G1 respectively.

Like the conventional method, the method shown in FIGS. 8 to 11 comprises a placing step followed in succession by a first seaming operation and a second seaming operation. The placing step comprises locating the cover 74 on the filled body 70 which is resting on the lift pad, the chuck 114 being then engaged within the chuck wall 122 to bear against the centre panel 124. Again, in both of the seaming operations, axial pressure is applied by the chuck and lift pad; With the container components in continuous rotation about their common axis, first the roll 116, and then the roll 118, is advanced towards the container axis to effect the respective first and second seaming operations.

However, because of the reduced size of the cover 74, the diameter of the flange 140 is very slightly greater than that of the edge 144 of the cover curl, so that the flange edge 144 lies just within the curl 132. For this reason, in the placing step the cover is snapped or sprung on to the body, this being made possible by the natural resilience of the flange 140.

Figure 9:
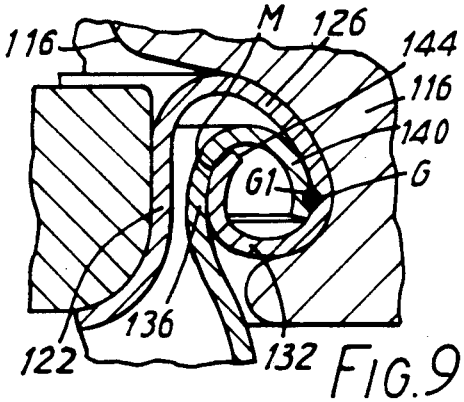
Figure 10:
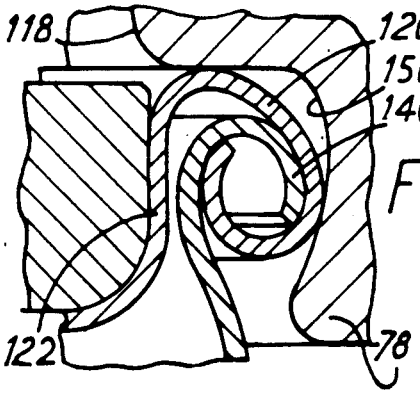
Figure 11:
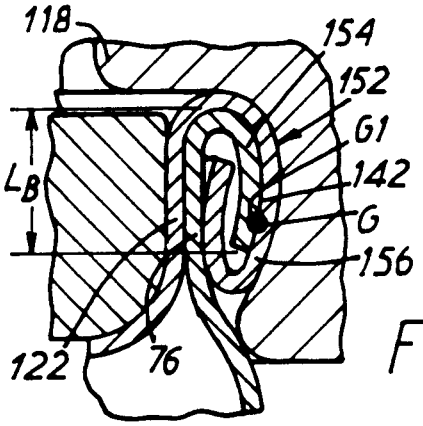

The relative positions of the various components at the start and end of the first seaming operation are as illustrated in FIGS. 8 and 9 respectively, while FIGS. 10 and 11 show the start and end of the second seaming operation. As the first and second seaming operations progress the outer edge 144 of the curl 132 is forced downwards and inwards to bear on the body sidewall end portion 136, causing this to be inwardly deformed to form eventually the neck indicated at 76 in FIG. 11.

It will be noted in FIGS. 8 and 9 that the working surface of the seaming groove 148 is in direct contact with the outer surface of that part of the seaming panel 126 which defines the interface 142, throughout the whole of the first seaming operation. This is in contrast to FIG. 3, which shows that the initial interface 42 in the prior art process is well away from the seaming roll 16.

Considering that part of the interface 142 represented in FIGS. 8 and 9 by the points G (in the seaming panel 126) and G1 (in the seaming flange 140), inspection of FIG. 8 shows that a force is exerted by the seaming roll 116 directly on the seaming panel 126, in a direction perpendicular to the tangent to the initial interface at the points G, G1. It will also be realized that this is still true in FIG. 9 and indeed at all stages of the operation between the stages shown in FIGS. 8 and 9. The effect of this is that there is always a positive force clamping the points G and G1 together, with the result that any significant relative movement between the seaming panel 126 and seaming flange 140 at the interface 142 is prevented. Thus, as shown in FIG. 9, points G and G1 are still contiguous at the end of the first seaming operation.

Similarly, in the second seaming operation (FIGS. 10 and 11, the working surface of the seaming groove 150 exerts on the same portion of the seaming panel a substantially transverse inward force, again perpendicular to the tangent to the interface 142 at the points G and G1. This causes the points G, G1 to remain clamped together, so that significant relative movement between panel 126 and flange 140 continues to be prevented, throughout the second seaming operation.

Thus, the initial interface 142 is preserved in the double seam, an important effect which can with advantage be utilized in aseptic packaging systems such as that to be described later herein with reference to FIG. 13.

As a result of the reduction in the diameter of the body end portion 136, a long body hook 154 can be produced without the assistance of the relatively large applied axial pressure P necessary in the prior art method. Accordingly, the value of the axial pressure P in the method of this invention (FIG. 1) need be no more than is sufficient to maintain the cover and the body in axial engagement with each other. Thus a well formed double seam, comprising the body hook 154 and cover hook 156, can be produced without risk of inducing body collapse due to excessive base pressure.

Reference is here made once again to FIG. 7, and the text above relating to FIG. 7. Where the container body is of a softer material than metal (e.g. plastics as in the present example, or if indeed it is of very thin metal, the cover being also of metal), there is a tendency for the wrinkles 64 to cut through the body sidewall material during the second seaming operation. The sidewall at a point L (FIG. 6) thus becomes perforated adjacent to the edge of the cover hook 56, giving rise to a leakage hazard. This unacceptable effect is at worst reduced but usually prevented, by the method shown in FIGS. 8 to 11, because during the first seaming operation, at the stage where wrinkling normally tends to occur, the curl 132 is supported against the body sidewall as indicated at M in FIG. 9. This support is continued through the second seaming operation, and has the additional effect that the cover curls tends to deform the sidewall end portion inwardly, so as to assist the reduction in girth of the end portion.

It will be noted that the sidewall end portion 136 is maintained out of contact with the chuck wall 122 throughout the first seaming operation (FIG. 9), being finally forced against it by virtue of the completion of the neck 76 in the second operation.

Figure 13:
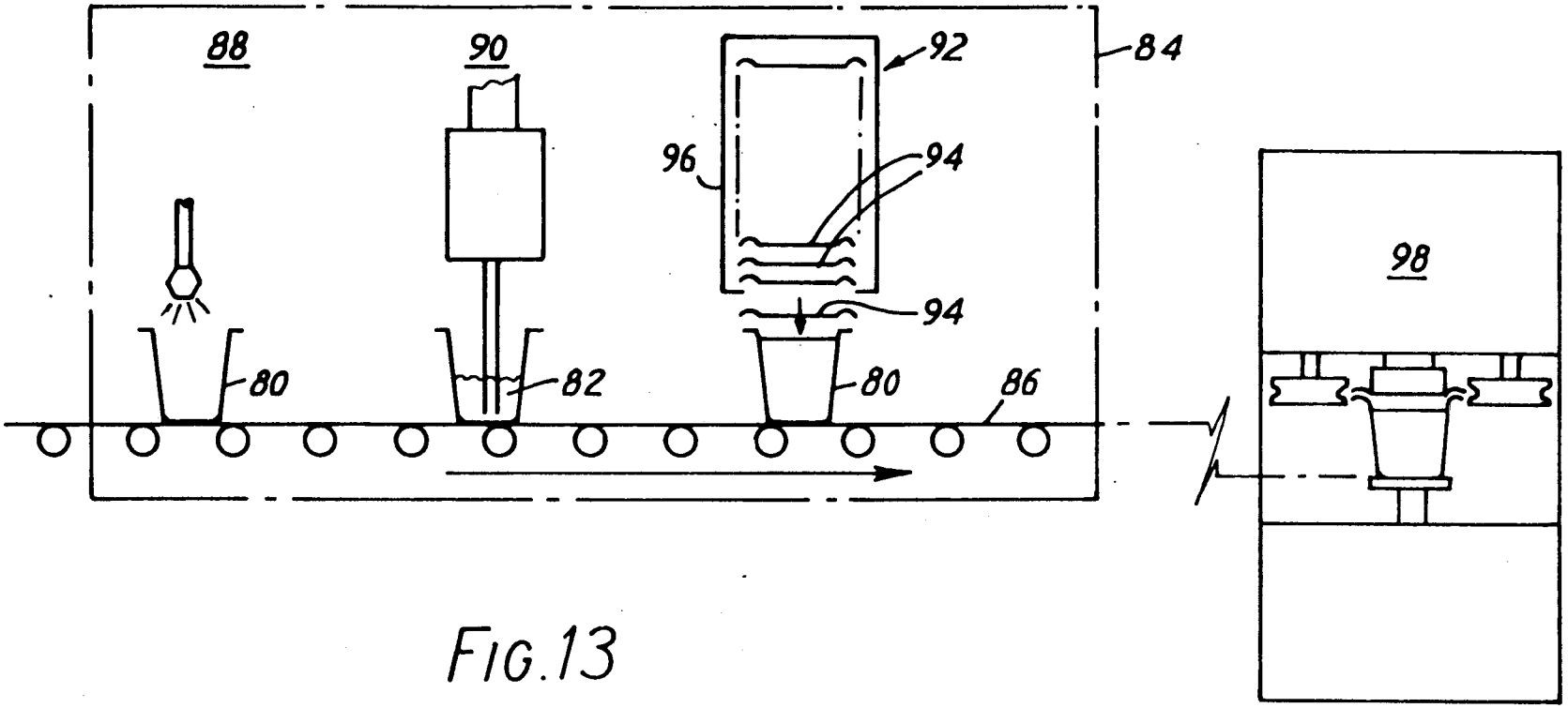
FIG. 13 is a diagram representing an aseptic packaging line equipped for performing a method according to the invention.

Referring to FIG. 13, an aseptic packing line, for filling container bodies or pots 80, of plastic material, with a food or drink 82, comprises an enclosure 84 maintained under sterile conditions in known manner. A conveyor 86 of any suitable kind extends through the enclosure 84, carrying the pots. Within the enclosure are a sterilising station 88, a filling station 90, and a lidding station 92. Each pot is sterilised by hydrogen peroxide at the station 88 in the usual way, and then filled with product 82 at the station 90, again in the usual way. At the lidding station 92, metal covers 94 are conveyed, by a descending scroll feeder device of known type (not shown), through a hot air oven 96, in which the covers are both sterilised and heated.

The hot covers are then applied to the filled pots 80 by a suitable placing device, not shown, below the oven 96. This constitutes the placing step of a double-seaming method, and includes the creation of a temporary hermetic seal at the interface 142 (FIG. 8) between each cover and its associated pot. The pots are now conveyed out of the sterile enclosure to a conventional double-seaming machine 98, situated in non-sterile conditions, the seaming step being performed by the machine 98 in the manner already described with reference to FIGS. 8 to 11 to form a permanent double seam.

The hermetic seal established by the location of the cover on the pot at the lidding station 92 is preserved, at least until the completion of the double seam, by virtue of the lack of movement between the components at the interface 142 and the fact that the surfaces of the interface are at all times in compression. The now non-sterile area of the cover curl indicated at 102 in FIG. 8 is not drawn into the primary seal area. The sterile pocket 104 of free space, between the chuck wall 122 and sidewall end portion 136, is progressively eliminated into the sterile interior of the pack without breaking the primary hermetic seal.

Figure 12:
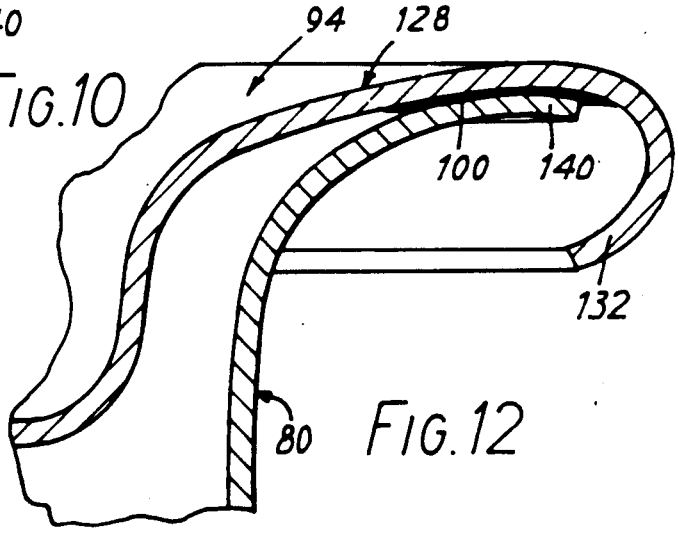
FIG. 12 shows a modification within the scope of the invention.

In order to be hermetic, the seal involves adhesion between the seaming flange 140 and the seaming panel 126 at the interface. The pot may be of a plastics material such that contact with the hot cover, causing local heating at the sealing interface 142, softens the surface of the flange 140 and causes it to adhere to the cover. Alternatively, the cover may advantageously be of a kind having on the underside of its seaming panel 126 a gasket or layer of a suitable lining or sealing material 100, FIG. 12. This gasket is softened in the oven 96 so as to form a hermetic seal of high integrity with the flange 140. Using a suitable commercially-available gasket material, a strong bond may be obtained, for example if the metal cover is pressed at the lidding station on to a polypropylene pot.

The container body and the cover may be of any materials such as to permit the novel method of doubled-seaming described above to be successfully performed to produce a seam having the integrity required for whatever purpose the container is intended for. Non-limiting examples include a steel or aluminium can body with a steel or aluminium cover, i.e., one having an integral or attached opening device, which may be of a self-opening or "easy-open" kind; a container body of plastics material such as polypropylene, polycarbonate, polyethylene or polyvinyl chloride, with a steel or aluminium can end as above; a metal or plastics body as above with a cover made of a plurality of materials; and a body made of a plurality of materials having a cover made of a plurality of materials or of metal or plastics as above. A body or cover of a plurality of materials may for instance be of laminated construction, or may comprise a number of components of different materials (e.g. a can end having a metal panel portion and plastics opening means). Such laminated constructions typically comprise one or more layers of plastics material, with or without a thin metal foil layer.

A plastics or laminated body or cover to be seamed by the method described may be made by thermoforming or any other suitable process.

At least where the container body is of metal, its sidewall is preferably of the smallest thickness that is both suitable for the packaging application for which the container is intended, and capable of withstanding the relatively modest axial loading applied during the seaming step. Where the body is of a multi-layer (laminated) construction, the layers can be of plastics or metal or both. If the body is of plastics, it may typically be thermoformed.

The sealed container may, for example, contain milk, milk products or other foodstuff or beverage or a product not intended for consumption by humans or animals. The product may be liquid, solid or both.

We claim:

1. A method of aseptic packaging comprising:

(a) providing a container body (70) and a container cover (74) in a substantially sterile condition;

(b) introducing a product into the container body under substantially sterile conditions, wherein the cover has a peripheral cover portion (120) which comprises an upstanding chuck wall (122) and a seaming panel (126) merging with the chuck wall and including a terminal cover curl (132), the body having a sidewall (72) terminating in a peripheral body portion which comprises a sidewall end portion (136) and a seaming flange (140) merging with said sidewall end portion;

(c) locating the seaming wall panel (126) in overlying contact with said seaming flange (140) to define an initial sealing interface (142) therebetween, while locating the chuck wall (122) within but out of contact with said sidewall end portion (136);

(d) wherein step (c) is performed under sterile conditions, the method further comprising removing the container body and container cover from said sterile conditions while maintaining the body and container cover in their relative location provided in step (c) and preserving the initial sealing interface, and then performing the following steps (e) and (f) under non-sterile conditions:

(e) applying directly to said seaming panel (126), and progressively around it, a force perpendicular to a tangent to the sealing interface (142), thereby holding said seaming panel sealingly against said seaming flange (140) at the sealing interface in the direction of said force, while progressively deforming said peripheral cover and body portions transversely inward to interlock them, without bringing the sidewall end portion (136) into contact with the chuck wall (122) and without significant relative movement between said seaming panel and flange at the sealing interface; and (f) applying directly to said seaming panel (126), and progressively around it, a substantially transverse inward force perpendicular to a tangent to the sealing interface (142), thereby reducing the sidewall end portion (136) in girth and forcing it against the chuck wall (122) while squeezing said peripheral cover and body portions together, without significant relative movement between said seaming panel (140) and flange at the sealing interface (142), whereby to form a double seam in which the initial sealing interface is preserved.

2. A method of aseptic packaging comprising:

(a) providing a container body (70) and a container cover (74) in a substantially sterile condition;

(b) introducing a product into the container body under substantially sterile conditions;

(c) wherein the cover (74) is secured to the container body (70) and the cover has a peripheral cover portion (120) which comprises an upstanding chuck wall (122) and a seaming panel (126) merging with the chuck wall and including a terminal cover curl (132), the body having a sidewall (72) terminating in a peripheral body portion which comprises a sidewall end portion (136) and a seaming flange (140) merging with the sidewall end portion;

(d) locating the seaming panel (126) in overlying contact with the seaming flange (140) to define an initial interface (142) therebetween while locating the chuck wall (122) within the side wall end portion (136);

(e) wherein step (d) is performed under sterile conditions, and further comprising removing the container body and cover from said sterile conditions while maintaining the body and cover in their relative location provided in step (d) and preserving the initial sealing interface (142) and then performing the following steps (f) and (g) under non-sterile conditions:

(f) progressively deforming the peripheral cover and body portions transversely inwardly to interlock them;

(g) squeezing the peripheral cover and body portions together to form a double seam (152), characterized in that:

in step (d) the initial interface (142) is an initial sealing interface and the chuck wall (122) is located out of contact with the sidewall end portion (136);

step (f) comprises applying directly to the seaming panel (126), and progressively around it, a force perpendicular to a tangent to the initial interface (142), thereby holding the seaming panel against the seaming flange at the initial interface in the direction of the said force, while progressively deforming the peripheral cover and body portions as aforesaid, without bringing the sidewall end portion into contact with the chuck wall and without significant relative movement between the seaming panel (126) and flange (140) at the initial interface; and step (g) comprises applying directly to the seaming panel (126), and progressively around it, a substantially transverse inward force perpendicular to a tangent to the initial interface (142), thereby reducing the sidewall end portion (136) in girth and forcing it against the chuck wall (122) while squeezing the peripheral cover and body portions together, without significant relative movement between the seaming panel (126) and flange (140) at the initial interface, whereby the initial interface (142) is perserved in the double seam;

the method being further characterized in that:

step (d) comprises so locating the seaming panel (126) in said overlying contact with the seaming flange 140 at the initial sealing interface (142) thereby created defines a continuous seal; and the absence of significant relative movement between the seaming panel and the flange at the sealing interface in steps (f) and (g) maintains the seal without interruption, whereby the initial sealing interface (142) is preserved in the double seam (152).

3. A method for aseptically packing a product (82) in a succession of containers, each having a pre-sterilized container body (80) and a pre-sterilized cover (94), the method including the steps of:

(a) introducing said product into the body of each container in turn at a first position (90) within a substantially sterile enclosure (84);

(b) transferring each container body after it has been so filled, to a second position (92) within said enclosure;

(c) wherein the container cover has a peripheral cover portion (120) which comprises an upstanding chuck wall (122) and a seaming panel (126) merging with the chuck wall and including a terminal cover curl (132), the body having a sidewall (72) terminating in a peripheral body portion which comprises a sidewall end portion (136) and a seaming flange (140) merging with the sidewall end portion;

(d) locating the seaming panel (126) in overlying contact with the seaming flange (140) to define an initial interface (142) therebetween while locating the chuck wall (122) within the sidewall end portion (136);

(e) performing step (d) and the following steps (f) and (g) on each filled container body;

(f) progressively deforming the peripheral cover and body portions transversely inwardly to interlock them;

(g) squeezing the peripheral cover and body portions together to form a double seam (152), characterized in that:

in step (d) the initial interface (142) is an initial sealing interface and the chuck wall (122) is located out of contact with the sidewall end portion (136);

step (f) comprises applying directly to the seaming panel (126), and progressively around it, a force perpendicular to a tangent to the initial interface (142), thereby holding the seaming panel against the seaming flange at the initial interface in the direction of the said force, while progressively deforming the peripheral cover and body portions as aforesaid, without bringing the sidewall end portion into contact with the chuck wall and without significant relative movement between the seaming panel (126) and flange (140) at the initial interface; and step (g) comprises applying directly to the seaming panel (126), and progressively around it, a substantially transverse inward force perpendicular to a tangent to the initial interface (142), thereby reducing the sidewall end portion (136) in girth and forcing it against the chuck wall (122) while squeezing the peripheral cover and body portions together, without significant relative movement between the seaming panel (126) and flange (140) at the initial interface, whereby the initial interface (142) is preserved in the double seam;

the method being further characterized that in respect of each successive container by performing step (d) thereon at said second position (92) and by the subsequent steps of transferring the filled container body, with its cover sealing located thereon, out of said enclosure to a seaming machine (98) and then using the seaming machine to perform steps (f) and (g) so as to form the double seam (152) of the container in non-sterile ambient conditions, whereby sterility of the interior of the container is preserved by virtue of the initial sealing interface (142) having been preserved.

4. A method of aseptic packaging in which a sterilized product is packaged in a container closed with a double-seamed cover, the method comprising:

(a) providing a container body and a container cover in a substantially sterile condition, the container cover having a peripheral cover portion which comprises an upstanding chuck wall and a seaming panel merging with the chuck wall and including a terminal cover curl, the container body having a sidewall terminating in a peripheral body portion which comprises on upstanding sidewall end portion and a seaming flange merging with the sidewall end portion;

(b) introducing a product into the container body under substantially sterile conditions;

(c) with the container body, the product in the container, and the container cover under said substantially sterile conditions, locating the seaming panel of the container cover in overlying contact with the seaming flange of the container body so as to create an initial sealing interface therebetween, that maintains the product within the container under said sterile conditions, while locating the chuck wall within but out of contact with the sidewall end portion;

(d) removing the container body, the product in the container, and container cover from said sterile conditions while maintaining the container body and container cover in their relative location provided in step (c) so as to preserve the initial sealing interface, and thereby maintain said sterile condition of the product, and then performing the following steps (e) and (f) under non-sterile conditions;

(e) applying directly to the seaming panel, and progressively around it, a force perpendicular to a tangent to the initial sealing interface, thereby holding the seaming panel sealingly against the seaming flange at the initial sealing interface in the direction of said force, while progressively deforming the peripheral cover and body portions transversely inward to interlock them, without bringing the sidewall end portion into contact with the chuck wall and without significant relative movement between the seaming panel and the seaming flange at the initial sealing interface; and (f) applying thereafter directly to the seaming panel, and progressively around it, a substantially transverse inward force perpendicular to the tangent to the initial sealing interface, thereby reducing the sidewall end portion in girth and forcing it against the chuck wall while squeezing the peripheral cover and body portions together, without significant relative movement between the seaming panel and seaming flange at the initial sealing interface, whereby there is formed a double seam in which the initial sealing interface is preserved to maintain the sterile condition of the product in the container.

5. A method according to claim 4, comprising an initial step of selecting the dimensions of the cover curl and seaming flange to be such that the initial sealing interface shall on completion of step (c) lie at least partly within the cover curl, step (c) further comprising snapping the terminal cover curl over the seaming flange of the container body.

6. A method according to claim 4, comprising applying to the cover throughout steps (e) and (f), to hold the container cover and the container body together as relatively axially located in step (c), just sufficient axial pressure to maintain such relative axial location.

7. A method according to claim 4, in which step (e) comprises turning the terminal cover curl inwardly and upwardly to bear against the sidewall end portion.

8. A method according to claim 4, in which step (c) includes interposing a layer of sealing material between the seaming panel and seaming flange so as to assist in the creation of a seal at the initial sealing interface.

9. A method according to claim 8, in which step (c) includes applying heat at the initial sealing interface whereby the sealing flange is bonded to the seaming panel.

10. A method according to claim 4, in which a gap is left between a lower part of a seaming roll and the sidewall in step (e).

11. A method according to claim 4, in which the beginning and end of step (e) are carried out with a first seaming roll, and step (f) is carried out with a second, different, seaming roll.

12. A method according to claim 4, including an initial step of selecting the cover to be of metal and the body to comprise plastics material defining inner and outer surfaces thereof.

* * * * *

UNITED STATES PATENT AND TRADEMARK OFFICE

CERTIFICATE OF CORRECTION

PATENT NO. : 5,054,265

DATED : October 8, 1991

INVENTOR(S) : John A. Perigo; Geoffrey Tucker

It is certified that error appears in the above-identified patent and that said Letters Patent is hereby corrected as shown below:

On the title page:

[63] Related U.S. Application Data, change "Feb. 9, 1989" to -- Feb. 17, 1989 --; and change "Jun. 16, 1988" to -- July 16, 1987 --.

FOREIGN PATENT DOCUMENTS, change "1220129 1/1974" to -- 1220129 1/1971 --.

Column 1, line 8, change "Feb. 9, 1989" to -- Feb. 17, 1989 --.
Column 1, line 11, change "June 16, 1988" to -- July 16, 1987 --.

Column 4, line 3, delete "seaming" (second occurrence).

Column 6, line 17, change "pad;" to -- pad. --.

Column 7, line 1, after "prevented" delete the comma.
Column 7, line 34, after "cover" change "curls" to -- curl --.
Column 7, line 42, after "aseptic" change "packing" to -- packaging --.

UNITED STATES PATENT AND TRADEMARK OFFICE

CERTIFICATE OF CORRECTION

PATENT NO. : 5,054,265

DATED : October 8, 1991

INVENTOR(S) : John A. Perigo; Geoffrey Tucker

It is certified that error appears in the above-identified patent and that said Letters Patent is hereby corrected as shown below:

Column 11, line 66, after "comprises" change "on" to -- an --.

Signed and Sealed this

Fourth Day of May, 1993

*Attest:*

Michael K. Kirk

MICHAEL K. KIRK

*Attesting Officer*

*Acting Commissioner of Patents and Trademarks*